United States Patent [19]

Joyce, Sr.

[11] Patent Number: 4,792,295

[45] Date of Patent: Dec. 20, 1988

[54] VARIABLE VOLUME ROTARY VANE PUMP-MOTOR UNITS

[76] Inventor: Benjamin N. Joyce, Sr., Rte. #6, Box 260, Bassett, Va. 24055

[21] Appl. No.: 22,239

[22] Filed: Mar. 5, 1987

[51] Int. Cl.[4] ..... F01C 1/344; F01C 19/04

[52] U.S. Cl. ..... 418/31; 418/148; 418/268

[58] Field of Search ..... 418/117, 147, 148, 267, 418/268, 31

[56] References Cited

U.S. PATENT DOCUMENTS

| | | | |
|---|---|---|---|
| 993,653 | 5/1911 | Coleman | 418/31 |
| 1,385,880 | 7/1921 | Master | 418/148 |
| 2,311,162 | 2/1943 | DuBois | 418/148 |
| 3,450,108 | 6/1969 | Rich | 418/148 |
| 3,776,203 | 12/1973 | Joyce, Sr. | 418/29 |
| 4,618,318 | 10/1986 | Hansen | 418/148 |

FOREIGN PATENT DOCUMENTS

| | | | |
|---|---|---|---|
| 65606 | 12/1982 | European Pat. Off. | 418/267 |
| 2504609 | 10/1982 | France | 418/148 |

*Primary Examiner*—John J. Vrablik

*Attorney, Agent, or Firm*—Stevens, Davis, Miller & Mosher

[57] ABSTRACT

The invention comprises a variable volume rotary vane pump or motor having an improved sealing relationship between vanes radially extending from a rotor and the inner cylindrical surface of an outer sleeve. The improved sealing is performed by means of vane caps (seals) which are urged radially outward against the inner circumferential wall of the outer cylinder by fluid pressure.

14 Claims, 4 Drawing Sheets

VARIABLE VOLUME ROTARY VANE PUMP-MOTOR UNITS

BACKGROUND OF THE INVENTION

In my previous U.S. Pat. No. 3,776,203, the disclosure of all of which is herein incorporated by reference, I disclosed variable volume rotary vane pumps. During the years since my disclosure of the invention set forth in U.S. Pat. No. 3,776,203 much research and improvements have been made in rotary motion devices of the type disclosed in my previous patent. As is known in the art, the variable volume vane portions comprise a series of vanes which are located in slots, spaced around the circumference of a rotor, whose radiallly inner edges sometimes bear in contact with the bottom of the slots and whose radially external edge or head bears against the internal cylindrical surface of an outer sleeve as is described in my previous patent.

In devices of this type it is therefore necessary for the vanes to come into sealing contact with the walls of the outer sleeve while simultaneously preventing undue friction between the vanes and sleeve that would lead to wear and failure of either, or both, of these components. Because rotary devices of this type complete numerous rotations during each minute of use, it is of little wonder that the primary focus of those skilled in the art has been various attempts to promote efficient sealing contact of vanes and sleeve. Such prior art attempts employ biasing means, such as springs to assure contact of the vanes with the sleeve. However, these prior art devices are insufficient to assure adequate sealing contact, and, in the event of failure of biasing means, the devices need to be completely disassembled to replace the biasing elements.

U.S. Pat. No. 4,225,308 illustrates the use of a spring to bias the vanes radially outwardly against the internal cylindrical surface of an outer sleeve. The presence of such biasing means is insufficient to assure adequate sealing between the vanes and the internal circumference of the outer sleeve.

U.S. Pat. No. 4,222,718, although recognizing the problem of wear in a hydraulic pump or motor does not address the problem of providing adequate sealing of the vanes with the inner cylindrical wall of the outer sleeve while also preventing undue wear of the contacting surfaces.

Thus, although attempts have been made in prior art systems, for example, such as those described in the aforementioned patents, there has still been a need for a more efficient mechanism to assure effective sealing of the vanes of a rotary motor or pump with the internal cylindrical walls of an outer sleeve while simultaneously avoiding excessive wear thereof. Additionally, there is required a rotary rotor or pump of improved reliability and requiring less maintenance and repair.

SUMMARY OF THE INVENTION

It is, therefore, an object of this invention to provide a variable volume rotary vane pump or motor which overcomes the above-noted disadvantages.

It is another object of this invention to provide an improved variable volume rotary vane pump or motor including means for forming a sealed space between adjacent vanes and the internal circumference of a portion of a cylindrical outer shell.

It is a further object to provide a variable volume rotary vane device which includes a shaft mounted, eccentric, rotor rotatable within a cylindrical sleeve including a plurality of radially mounted vanes mounted in bores in the rotor with vane caps (seal means) mounted on said vanes so as to contact the inner cylindrical wall of an outer sleeve.

In another embodiment of the invention it is an object provide a plurality of vanes having a head and shaft in the general shape of a T or Y for use in a variable volume rotary vane device of the type herein described, with the head of the T or Y being provided with at least two grooves, each of which are adapted to receive a vane cap (seal means).

It is a further object of the invention to provide a variable volume rotary vane device which uses the fluid pressure within such device to effect the seal between each of the vanes and the inner circumferential surface of an outer sleeve.

The foregoing objects and others are provided in accordance with the present invention in a variable volume rotary vane device which includes a shaft mounted, eccentric, rotor rotatable within a cylindrical sleeve including a plurality of radially mounted vanes mounted in bores in the rotor so as to define a plurality of chambers between said rotor, said vanes and said sleeve, the improvement comprising, providing said vanes with a head and shaft in the general shape of a T or Y with the head of the T or Y positioned proximate the sleeve and providing on the head of said T or Y at least two grooves each adapted to receive a vane cap (seal means), which seal means together with said head of the vanes and the cylinder define a closed space, and a conduit for placing each of said grooves in fluid communication with at least one of said chambers.

BRIEF DESCRIPTION OF THE DRAWINGS

For a better understanding of the invention as well as other objects and further features thereof, reference is made to the following detailed disclosure of preferred embodiments of the invention taken in conjunction with the accompanying drawings thereof, wherein.

DETAILED DESCRIPTION OF THE PREFERRED EMBODIMENTS

Figure 1:
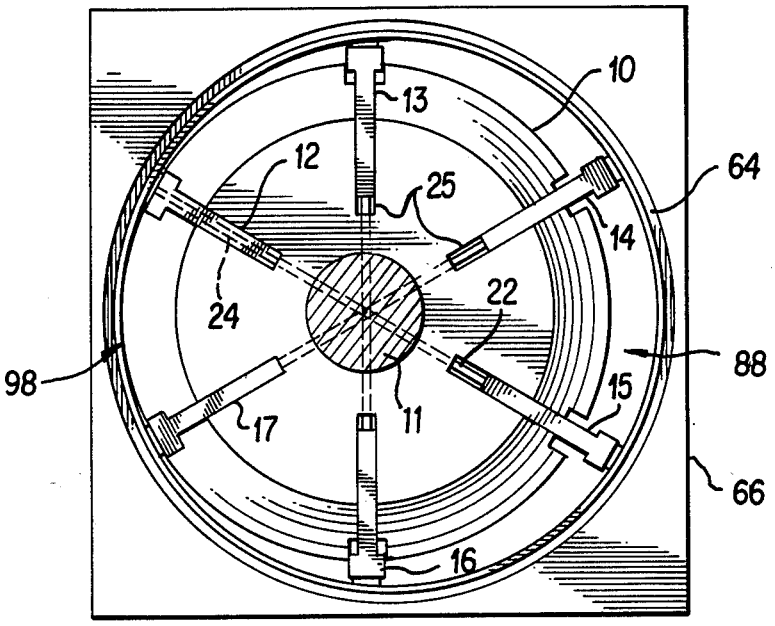
FIG. 1 is a partially schematic view of a preferred embodiment of the variable volume rotary vane pump of the present invention.

FIG. 1 illustrates a preferred embodiment of the variable volume rotary vane pump. Rotor 10, eccentrically mounted on a shaft 11 carries a plurality of vanes 12, 13, 14, 15, 16, 17. During rotation of rotor 10 each of the vanes in turn is brought into sealing relationship with the inner circumferential surface of outer cylinder or sleeve 34. Vanes 12–17 are of general T or Y (FIG. 8) configuration having a head end proximate the outer cylinder 34. Opposite the head portion each vane 12–17 comprises a shaft portion mounted in bores 25 within rotor 10. Spring 18 and pins 20, 22 position vanes 12–17 within the bores 25 with each spring 18 biasing the vane 12–17 radially outward of rotor 10.

Figure 4:
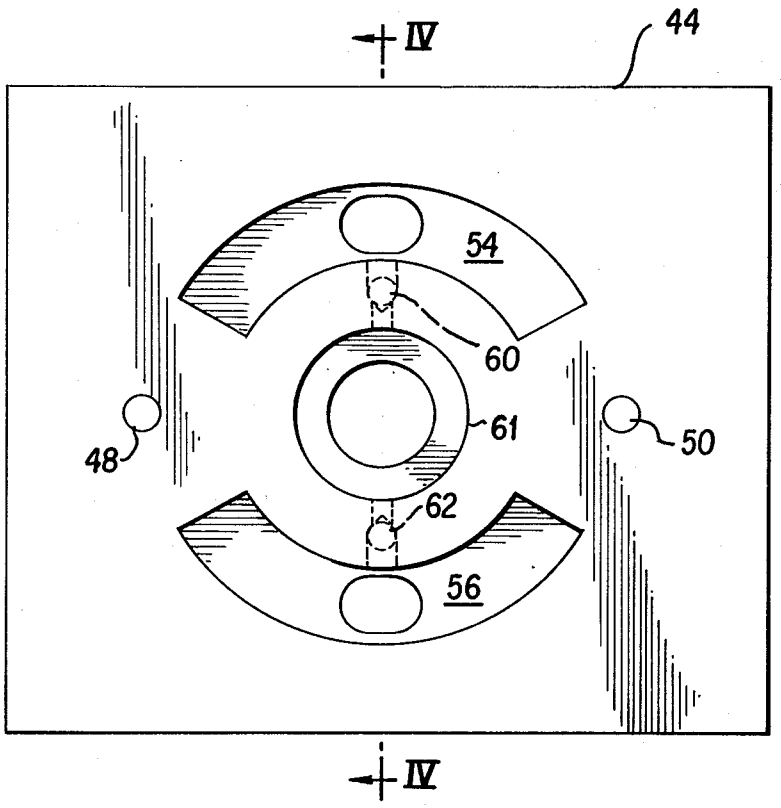
FIG. 4 is an end view of the rotary pump device illustrating the placement of check valves to compensate for leakage inside the pump device.

In one embodiment of the invention relief drain holes 24 are provided in each of vanes 12–17 so as to remove any fluid adjacent the head portion of vanes 12–17. These relief drain holes 24 drain any fluid entering area X through bores 25 in rotor 10, along shaft 11 to groove 61 (FIG. 4). The fluid may then pass to the low pressure side of either inlet 54 or outlet 56 through check valves 60, 62 respectively.

Figure 2:
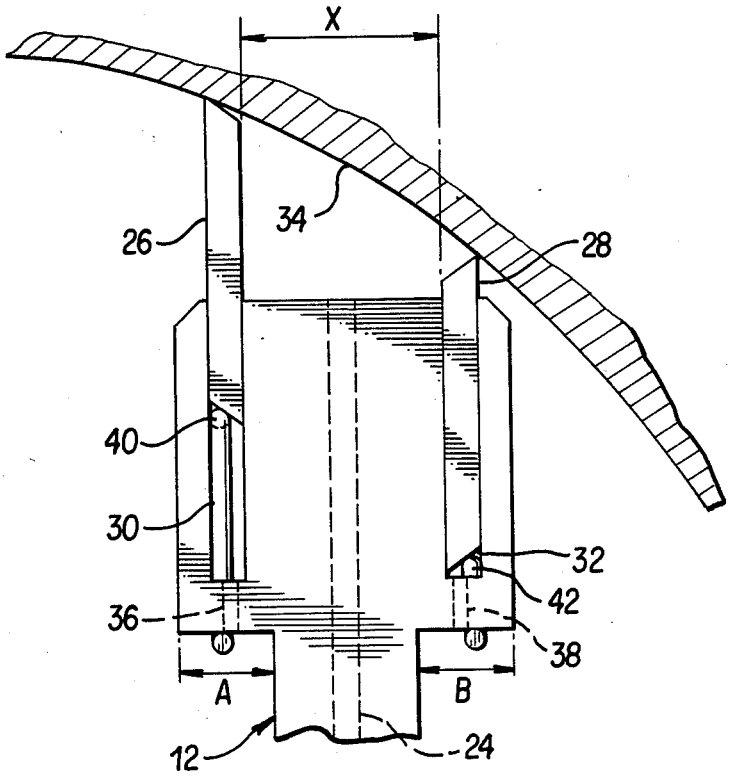
FIG. 2 is an enlarged view of a portion of FIG. 1 showing the details of the vane cap (seal means) on the head of one of the vanes.
Figure 2A:
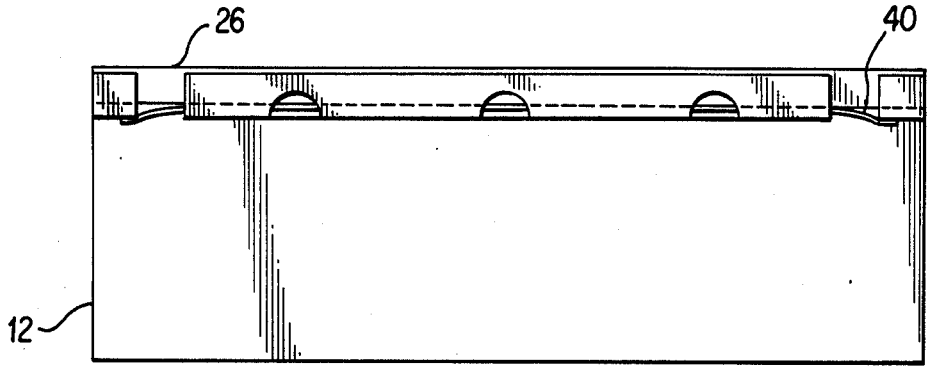
FIG. 2A is a side view of a vane according to the present invention.
Figure 3:
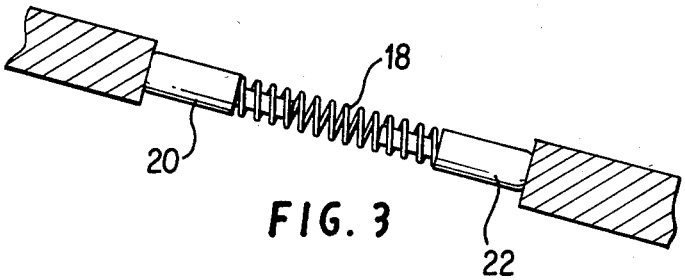
FIG. 3 is an enlarged view of a portion of FIG. 1 showing the details of the spring and pin means to position the vanes within bores in the rotor.
Figure 8:
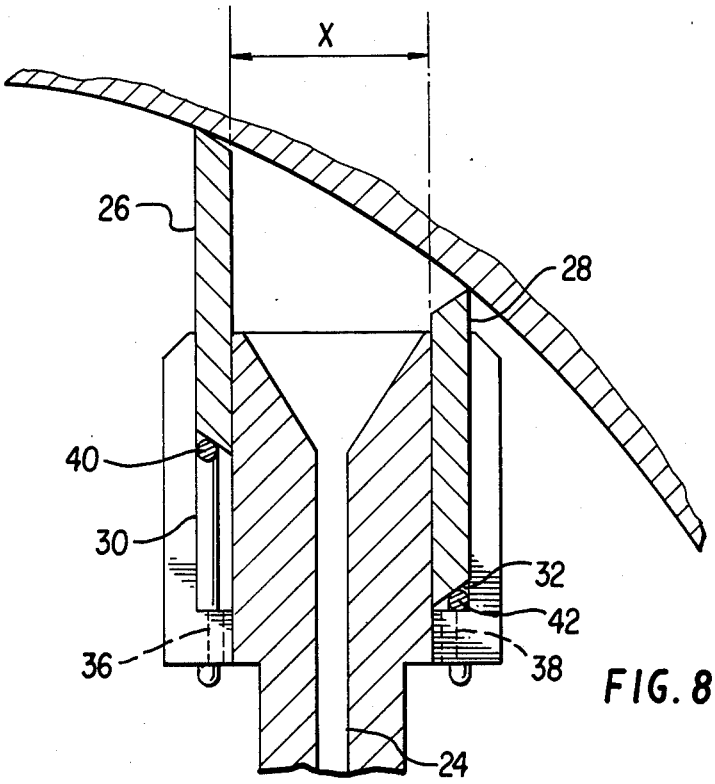
FIG. 8 is a sectional view similar to FIG. 2, but illustrates an alternative, generally Y shaped vane.

As can be best seen in FIGS. 2 and 8, relief drain holes 24 form a conduit for fluid communication through the head and shaft portion of vane 12 whereby fluid can be removed from a point proximate the head of vane 12 to a point remote from said head. FIGS. 2 and 8 also show an enlarged view of vane caps, which for sake of simplicity will hereinafter be referred to as seals 26 and 28, in their respective grooves 30 and 32, in the head portion of vanes 12–17. Seals 26 and 28 are formed of a metal, preferably a non-ferrous material, more preferably of brass strips held generally parallel within grooves 30 and 32. However, other materials such as composite materials may be used as seals 26 and 28. The ends of seals 26 and 28 distal from the cylindrical wall of the outer sleeve are preferably beveled in the manner illustrated in FIGS. 2 and 8. The ends of the seals 26 and 28 adjacent the cylindrical wall are beveled generally parallel to the bevel previously discussed, although the angle of bevel is not required to be parallel and thus is not a critical feature of the invention. All that is required is that a point of seal be formed between the beveled portion of the seal and the cylindrical wall during rotation of the rotor. Although two seals 26, 28 have been illustrated, it is to be understood that more or less may be employed without departing from the scope of the invention.

It is to be understood that the rotation of rotor 10 creates a centrifugal force urging each of vanes 12–17 radially outward. In a similar fashion, each of seals 26 and 28 are also urged radially outward so as to contact the inner cylindrical surface of outer sleeve 34. The present applicant has found that the sealing effect of the present invention can surprisingly be increased by providing slots 36 and 38 in each of grooves 30 and 32, respectively. Slots 36 and 38 permit the pressurized fluid within the pump or motor to enter grooves 30 and 32 which causes a force to be exerted on the beveled portions of seals 26 and 28 within each of bores 30 and 32. The force applied by this fluid pressure would be normally counterbalanced by a force acting upon the beveled portion of the seal proximate the inner surface of outer sleeve 34. However, due to relief drain hole 24 the area X circumscribed by seal 26, and seal 28, on the head of vane 12 beneath the inner surface of outer sleeve 34 forms a pressure-free area X on the top surface of the vanes. This pressure-free area X thus permits the force developed by fluid pressure acting on the beveled surfaces of seals 26 and 28 within bores 30 and 32 to urge the seals 26 and 28 radially outward from the head of vanes 12–17. In order to provide a uniform biasing force in addition to the fluid force or when the pump or motor is in an unpressurized condition, a wire spring 40, 42 may be positioned in each of bores 30 and 32, respectively. This wire spring 40, 42 need only be sufficient to urge the seals radially outward when no or little internal fluid pressure exists in the pump or motor.

Although slots 36 and 38 are illustrated as being radially oriented, such orientation is not required. All that is required is that slots 36, 38 provide fluid communication between grooves 30 and 32 and the pressurized fluid in the device.

In order to further assist the radially outward movement of vanes 12–17 toward the inner wall of outer sleeve 34 springs 18 may be employed in the manner previously described. However the present inventor also relies upon the fluid pressure exerted on the underside of the head of vanes 12–17 to urge vanes 12–17 radially toward the inner wall of outer sleeve 34. As can be appreciated, with reference to FIG. 2, the pressure-free area X on the top surface of the vane 12, together with seals 26 and 28 present only a small surface area of the remainder of the head upon which the fluid pressure may act whereas the opposite surfaces A, B of the head of vane 12 present a greater surface upon which the fluid pressure may act. Because the pressure of the fluid acting on both the top and underside of the head of vane 12 is at the same pressure the greater surface area A, B of the underside of the head of vane 12 will create a force tending to move vane 12 radially outward which is greater than that force created by the fluid acting on the head of vane 12 proximate the inner wall of outer sleeve 34. Vane 12 will thus be urged radially outward by the combination of forces including that of biasing spring 18, the unbalanced fluid force which is greater on the underside of the head of vane 12, and the centrifugal force due to rotation of rotor 10. In addition, each of seals 26 and 28 will also be urged radially outwardly due to the fluid pressure within grooves 30 and 32 entering through slots 36 and 38, respectively, which together with the biasing force of wire springs 40 and 42 and the centrifugal force exerted on each of seals 26 and 28 due to rotation of rotor 10 provide efficient sealing of the vane 12 and inner wall of outer sleeve 34.

It will thus be appreciated that the present invention overcomes the disadvantages of the prior art in assuring that a point seal will be formed so as to create a plurality of closed chambers between adjacent vanes 12–17, rotor 10 and the inner wall of outer sleeve 34. It is of course understood that the spring tension of each of wire springs 40 and 42 as well as that of 18 can be significantly reduced over those of the prior art, being only sufficient to bias the elements radially outwardly in the absence of fluid pressure. Thus, excessive wear of the sealing surfaces will be reduced and loss of seal will not normally be encountered by failure of mechanical springs, such as springs 18 or wire springs 40, 42.

As shown in FIG. 4 the end cap 44 which is bolted to outside housing 46 is provided with seal inspection plugs 48 and 50 which are positioned over the outer vane path of seals 26 and 28 in their normal path of travel. Upon removal of seal inspection plugs 48 or 50 access openings 52 (only one of which is shown in FIG.

5) permit replacement of seals 26, 28 without further disassembly of the device. This feature greatly simplifies the maintenance required over previous variable rotary vane pumps or motors which required disassembly of the entire device to replace defective vanes or springs.

Figure 5:
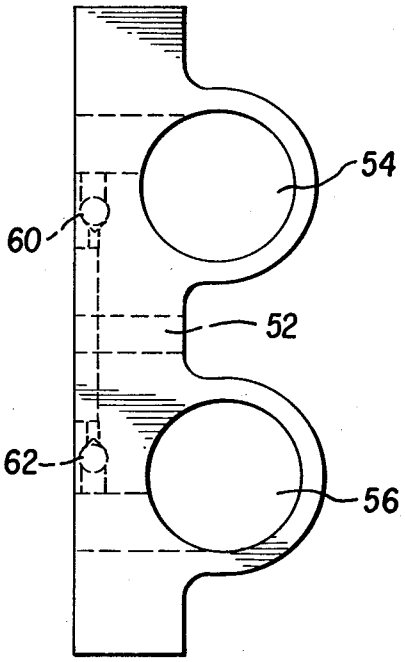
FIG. 5 is a side view of FIG. 4 illustrating the seal inspection plug and access opening for replacement of the seal means.

As illustrated in FIG. 5, it should be appreciated that the present device may be operated as a pump or a motor by merely reversing the direction of fluid flow from inlet 54 to outlet 56. Of course when flow is reversed, outlet 56 will act as an inlet and inlet 54 will act as an outlet. Thus each of elements 54 and 56 may properly be termed as an inlet-outlet. However, in addition to reversing the direction of rotation by means of reversing the flow from inlet 54 to outlet 56, or vice versa, it is also possible to vary the size of eccentric cavities 88, 98, FIG. 1, to accomplish not only reverse rotation but also variable displacement. The operation will be understood with reference to FIG. 6 described hereinbelow. Of course these eccentric cavities 88, 98 may be present even when not used when rotation is controlled mechanically.

Suitable fluids for use in the pump or motor of the present invention include liquids and gases. Preferred fluids include hydraulic and pneumatic fluids.

In another embodiment of the invention check valves 60, 62 are provided for directing leakage within the device to the inlet when the device is operating as a pump and to the outlet when it is operating as a motor.

Figure 7:
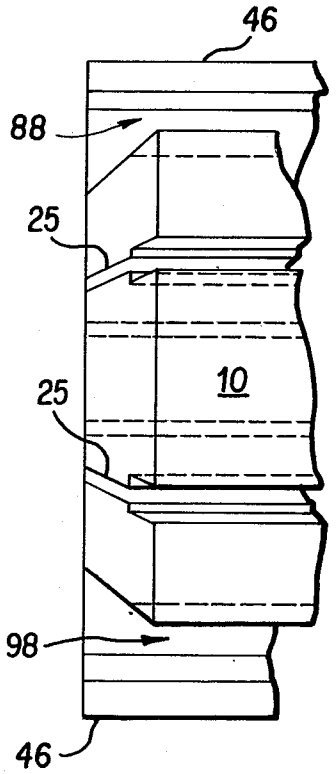
FIG. 7 is a side view of FIG. 1 illustrating the beveled end of the rotor as well as fluid inlet and outlet means.

FIG. 7 is an end view of FIG. 1, further illustrating and bores 25 within rotor 10. This view does not illustrate vanes 12–17 which would normally be positioned in bores 25 when the device is assembled for operation. The position of O-ring seal 64 which prevents leakage between outer ring 66 and rotor 10 is best illustrated in FIGS. 1 and 6.

Outside housing 46 is provided with drilled and tapped openings 76 to which end cap 44 (FIG. 5) may be bolted.

Figure 6:
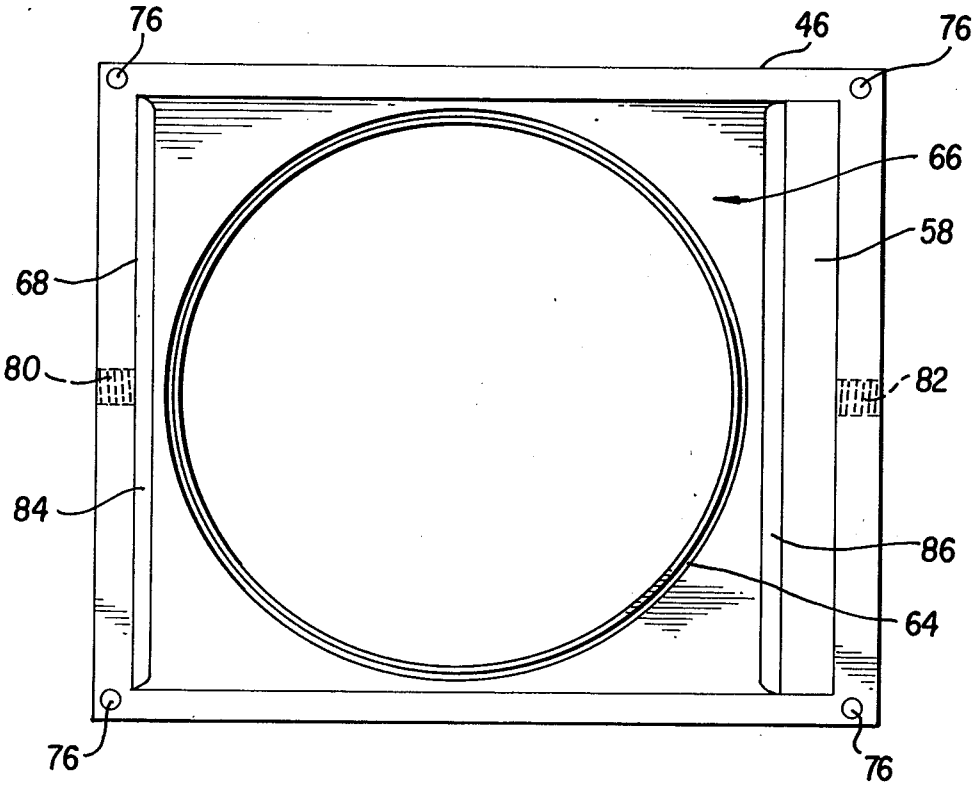
FIG. 6 is a top view of the variable volume rotary vane pump illustrating the outer ring and the cavity for variable displacement and reverse rotation of the pump or motor.

With reference to FIG. 6, it will be appreciated that outer ring 66 is mounted for lateral, shuttling movement within outside housing 46. As illustrated in FIG. 6 outer ring 66 is moved toward its leftward limit fully exposing eccentric cavity 98 (FIG. 1). Because outer ring 66 moves relative to rotor 10, the eccentric cavity 98 (FIG. 1) will be larger than eccentric cavity 88 (FIG. 1) when the outer ring is in the position shown in Figure 6. It should be appreciated that shuttling of the outer ring 66 toward its rightward limit in FIG. 6 would expose a variable displacement cavity 88 FIG. 1 (FIG. 7) on its right end while diminishing eccentric cavity 98 on its left end. Thus, outer ring 66 acts as a piston to shuttle or reciprocate between the leftward and rightward limits in outside housing 46. Openings 80 and 82 alternately permit fluid ingress and egress to cavities 68 and 58, respectively. In order to seal outer ring 66, seals 84, 86 are provided on the outer ring 66. It should be appreciated that additional seals (not shown) may be positioned adjacent the top and bottom portions of outer ring 66 near outside housing 46. A conventional O-ring seal 64 extends about the periphery of the central opening of outer ring 66 as shown in FIG. 6.

FIG. 8 is similar to FIG. 2 but illustrates an alternative Y shaped vane.

Although specific components and designated proportions and arrangements of elements have been stated in the above decription of the preferred embodiments of this invention, other suitable equivalent components and arrangements of elements may be used with satisfactory results in various degrees of quality of or other modifications may be made in a system to enhance its construction to thereby increase its utility. It will be understood that such changes of details, materials, arrangement of parts, and uses of the invention described and illustrated herein are intended to be included within the principles and scope of the claimed invention.

What is claimed is:

1. An improved means for sealing a rotary device wherein sealing contact between a rotating element and an inner surface of an outer sleeve is desired comprising a rotary element including an enlarged head thereon, a seal means mounted on said head, said seal means and said rotary element each urged radially outward towards said inner surface by means of fluid pressure existing within said device and acting upon each of said enlarged head and said seal means.

2. The means for sealing of claim 1, wherein the rotating element is a vane.

3. The means for sealing of claim 2, wherein the vane is provided with at least one groove to carry the seal means.

4. The means for sealing of claim 3, wherein the fluid pressure is communicated to said groove through an aperture in said vane.

5. In a variable volume rotary vane device wherein a plurality of vanes are sequentially brought into sealing engagement with a surface of an outer sleeve, the improvement comprising, providing an enlarged head on said vanes and vane caps on the head of each of said vanes and applying a fluid force to each of said head and vane caps to urge the head and vane caps into sealing contact with the outer sleeve.

6. The variable volume rotary vane device of claim 5, wherein each head is provided with at least two vane caps.

7. The variable volume rotary vane device of claim 6, wherein the circumscribed area of each of said vanes between said at least two vane caps is drained by a relief drain in fluid communication with the circumscribed area of said vanes.

8. The variable volume rotary vane device of claim 5, wherein said vanes are T-shaped.

9. The variable volume rotary vane device of claim 5, wherein said vanes are Y-shaped.

10. In a variable volume rotary vane device which includes a shaft mounted, eccentric, rotor rotatable within a cylindrical sleeve including a plurality of radially mounted vanes mounted in bores in the rotor so as to define a plurality of chambers between said rotor, said vanes and said sleeve, the improvement comprising, providing said vanes with a head and shaft in the general shape of a T or Y with the head of each vane positioned proximate the sleeve and providing on the head of each of said vanes at least two grooves each adapted to receive a seal means wherein the seal means are mounted on the head of the vanes so as to circumscribe a surface area on the head of the vanes proximate said cylindrical sleeve, wherein the head of the vane is sized and shaped such that the surface area of the head adjacent said shaft is greater than the surface area of the head adjacent said cylindrical sleeve lying outside said circumscribed surface area, which seal means together with said head of the vanes within said circumscribed surface area and the cylindrical sleeve define a closed space, and a conduit for placing each of said grooves in fluid communication with at least one of said chambers.

11. The variable volume rotary vane device of claim 10, wherein each said groove contains spring means to bias the seals toward said cylindrical sleeve.

12. The variable volume vane device of claim 10, wherein each said seals is beveled at its end proximate said cylindrical sleeve, the slope of said beveled portions extending inwardly towards the closed space.

13. The variable volume rotary vane device of claim 10, wherein each of said vanes is provided with a means to relieve the pressure in said closed space.

14. The variable volume rotary vane device of claim 13, wherein the means to relieve the pressure is a bore in fluid communication with the interior of said closed space.

* * * * *